US007614328B2

(12) United States Patent
Perini

(10) Patent No.: US 7,614,328 B2
(45) Date of Patent: Nov. 10, 2009

(54) APPARATUS AND METHOD FOR CAUSING PAPER WEBS TO TEAR OFF WITHIN REWINDING MACHINES

(76) Inventor: Fabio Perini, Via S. Francesco 1, I-55049 Viareggio (Lucca) (IT)

( * ) Notice: Subject to any disclaimer, the term of this patent is extended or adjusted under 35 U.S.C. 154(b) by 422 days.

(21) Appl. No.: 10/549,843

(22) PCT Filed: Mar. 22, 2004

(86) PCT No.: PCT/IT2004/000140

§ 371 (c)(1),
(2), (4) Date: Sep. 14, 2005

(87) PCT Pub. No.: WO2004/096684

PCT Pub. Date: Nov. 11, 2004

(65) Prior Publication Data

US 2006/0169733 A1 Aug. 3, 2006

(30) Foreign Application Priority Data

Apr. 28, 2003 (IT) ..... FI2003A0118

(51) Int. Cl.
*B26F 1/26* (2006.01)

(52) U.S. Cl. ..... 83/177; 83/99; 83/937; 83/949; 242/526; 242/527.1; 225/93

(58) Field of Classification Search ..... 83/53, 83/177, 99, 431, 98, 24, 100, 343–347, 78, 83/909, 924, 937, 949–950; 242/521–527.4, 242/487.1, 487.7; 226/7, 95, 97.1, 97.3; 492/16–20; 53/389.3; 225/93
See application file for complete search history.

(56) References Cited

U.S. PATENT DOCUMENTS

| | | | | |
|---|---|---|---|---|
| 1,878,184 | A * | 9/1932 | Roesen | 242/555.5 |
| 4,099,435 | A | 7/1978 | Young | |
| 4,216,687 | A * | 8/1980 | Passafiume et al. | 83/26 |
| 4,923,567 | A * | 5/1990 | Liedes et al. | 162/193 |
| 5,603,467 | A | 2/1997 | Perini et al. | |
| 5,759,350 | A * | 6/1998 | Pyron et al. | 162/191 |
| 5,901,917 | A | 5/1999 | Schmidt et al. | |
| 6,058,817 | A * | 5/2000 | Kobayashi et al. | 83/24 |

(Continued)

FOREIGN PATENT DOCUMENTS

| | | |
|---|---|---|
| DE | 23 30 195 | 1/1975 |

(Continued)

*Primary Examiner*—Boyer D. Ashley
*Assistant Examiner*—Laura M. Lee
(74) *Attorney, Agent, or Firm*—McGlew and Tuttle, P.C.

(57) ABSTRACT

Apparatus for causing paper webs to tear off within rewinding machines, the said web (2) being provided, at regular intervals, with transverse perforation which subdivide the web into sheets joined to each other but able to be separated in correspondence of said perforation lines, the apparatus comprising means to cause the tearing of the web (2) upon the passage of a perforation line (p) which separates the last sheet of a log (RO) in the course of formation from the first sheet of the next log to be formed, characterized in that the said tearing means are of pneumatic type (SP) able to direct a jet of compressed air toward the said line (p).

6 Claims, 9 Drawing Sheets

U.S. PATENT DOCUMENTS

| | | | | |
|---|---|---|---|---|
| 6,173,636 | B1 * | 1/2001 | Madrzak et al. | 83/601 |
| 6,328,248 | B1 | 12/2001 | Kaipf | |
| 2001/0015394 | A1 | 8/2001 | Hendrix | |
| 2002/0117575 | A1 | 8/2002 | Gilmore et al. | |
| 2007/0181734 | A1 * | 8/2007 | Corrado et al. | 242/526 |

FOREIGN PATENT DOCUMENTS

| | | |
|---|---|---|
| DE | 101 46 538 | 4/2003 |
| EP | 0 524 158 | 1/1993 |
| EP | 0 694 020 | 1/1996 |
| GB | 210568 | 2/1924 |

* cited by examiner

APPARATUS AND METHOD FOR CAUSING PAPER WEBS TO TEAR OFF WITHIN REWINDING MACHINES

The present invention refers to an apparatus and method for causing paper webs to tear off within rewinding machines. The production of logs is known to imply feeding a continuous web of paper along a predetermined path. At a given point of said path, a discontinuous transverse cut is operated on the web in order to subdivide it into sections or sheets of preset length which can be torn off.

This procedure comprises using tubular cardboard elements (commonly said "cores") on the surface of which a preset amount of glue is spread to allow gluing the first sheet of the log to be formed. The said procedure also provides for using winding rollers which drive into rotation the core on which the paper is wound. The log-forming process ends up when a preset amount of paper has been wound on the core. At this point, the formation of the next log begins. At the end of the formation process, it is necessary to glue the last sheet of each log on the underlying sheet to avoid the spontaneous unwinding of the same log. This type of gluing is defined as "edge closing". When a number of preset sheets result wound up on the log in the course of formation, the paper web is cut off, that is, the last sheet of the log in the course of formation is separated from the first sheet of the next log to be formed.

Patents EP 524158, GB 210568 and EP 694020 disclose devices used to cause the paper web to tear off at the end of the formation of the logs.

Such devices, however, are not suited for the present production requirements, as they are relatively unreliable or require frequent and costly service interventions.

The main object of the present invention is to overcome, or at least greatly reduce, the above drawbacks.

This result has been achieved, according to the invention, by adopting the idea of making an apparatus and applying a method having the characteristics indicated in the independent claims. Further characteristics being set forth in the dependent claims.

The advantages deriving from the present invention lie essentially in the fact that it is possible to ensure all the time the highest accuracy in causing the paper to tear off whatever the feeding speed, by eliminating abrupt movements and consequent vibrations that are likely to endanger the proper operation of the system; that an apparatus according to the invention is relatively easy to make, cost-effective as far as the maintenance is concerned, and reliable even after a prolonged service life.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
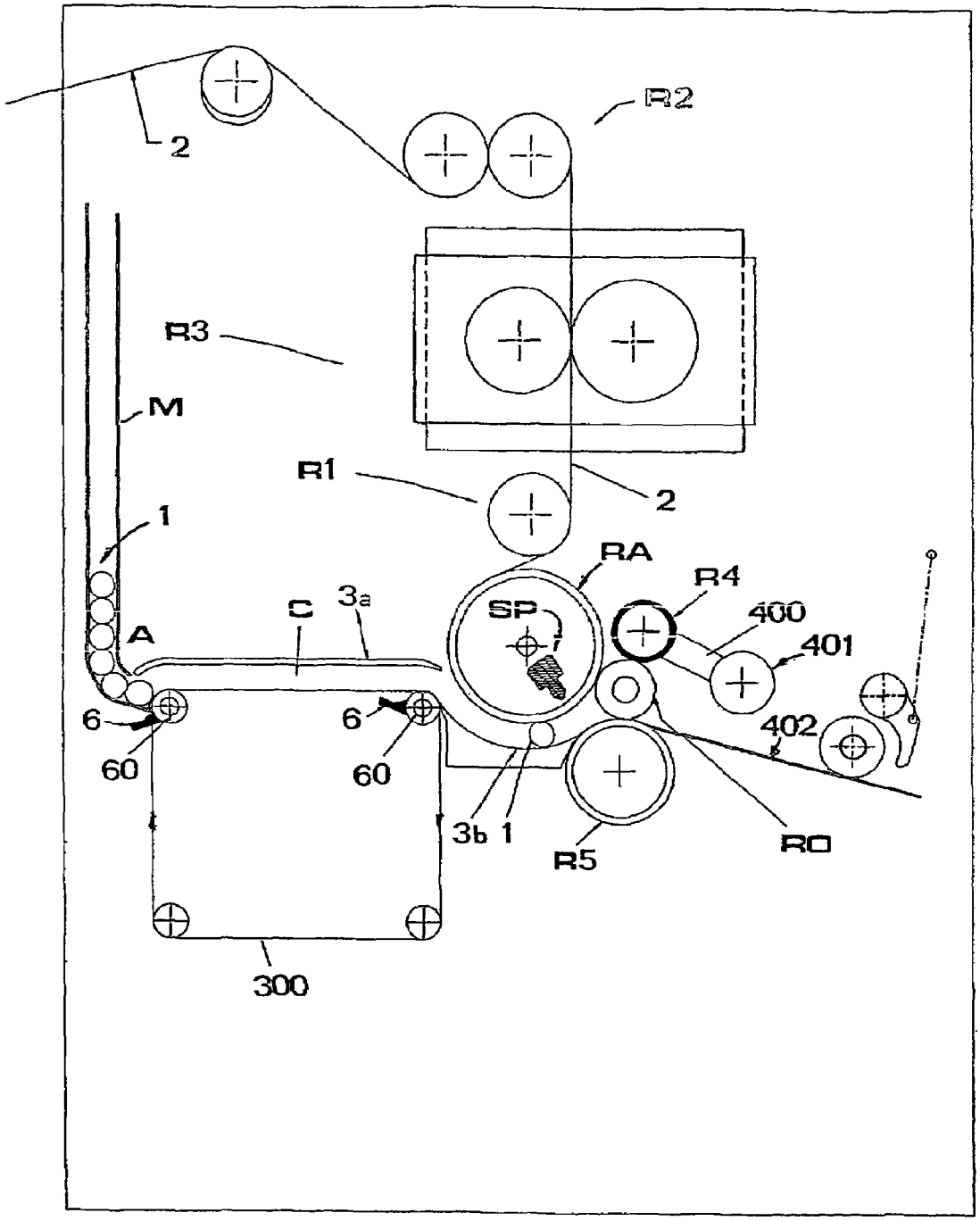
FIGS. 1 and 2 show a rewinding machine provided with an apparatus according to the invention, in two possible embodiments thereof.
Figure 2:
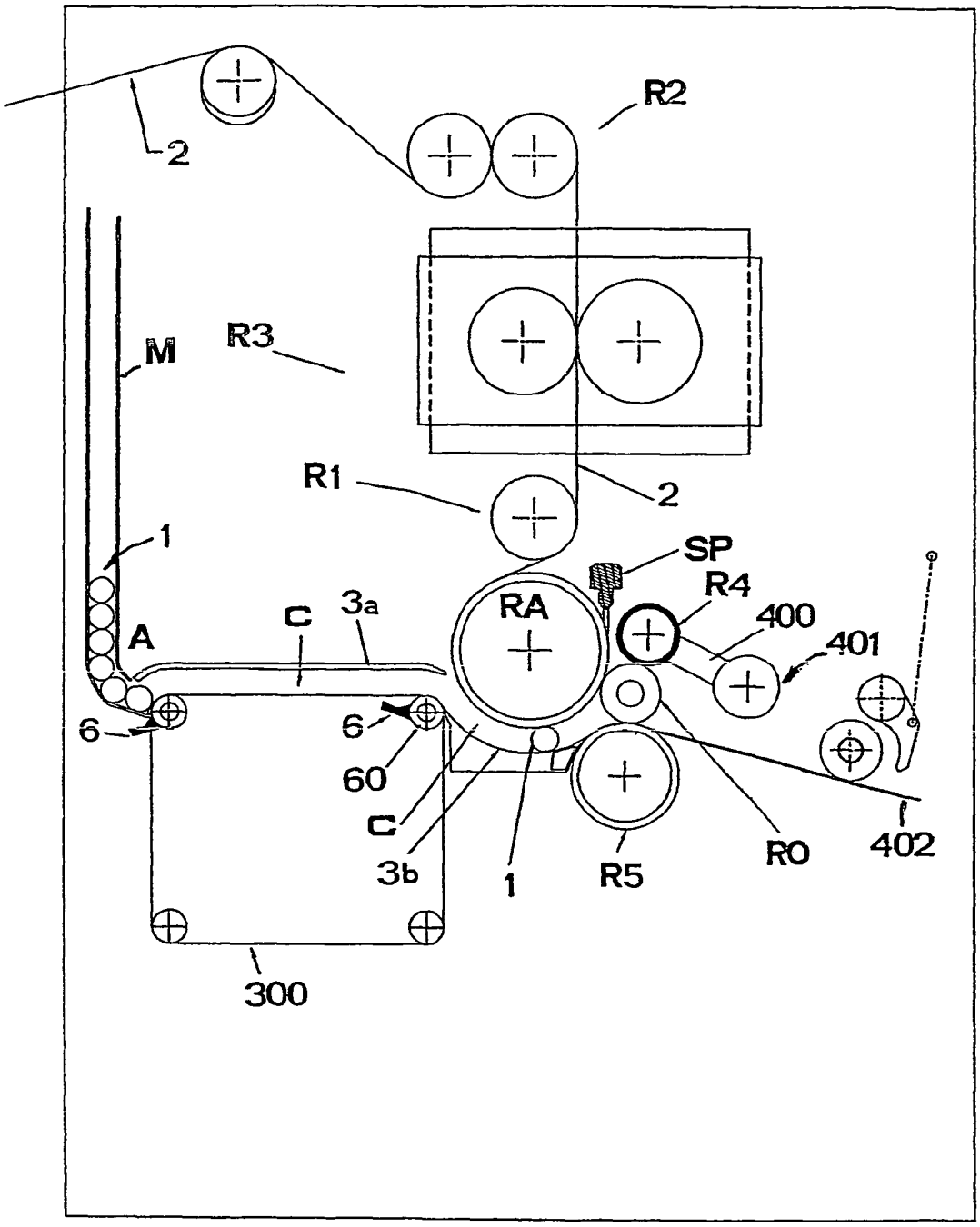
Figure 3:
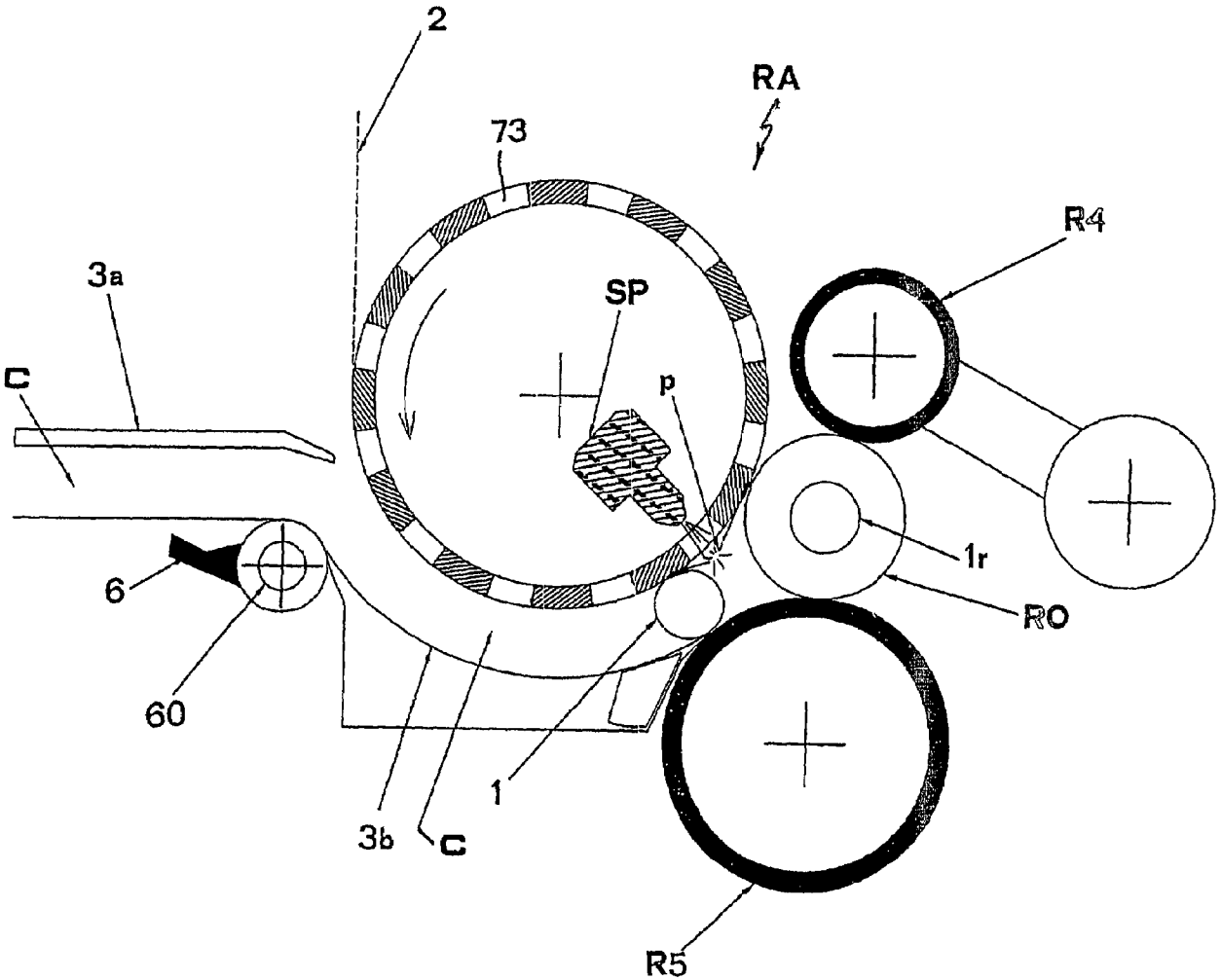
FIGS. 3 and 4 are enlarged details of FIGS. 1 and 2, respectively, which illustrate schematically the step of tearing the paper web.
Figure 4:
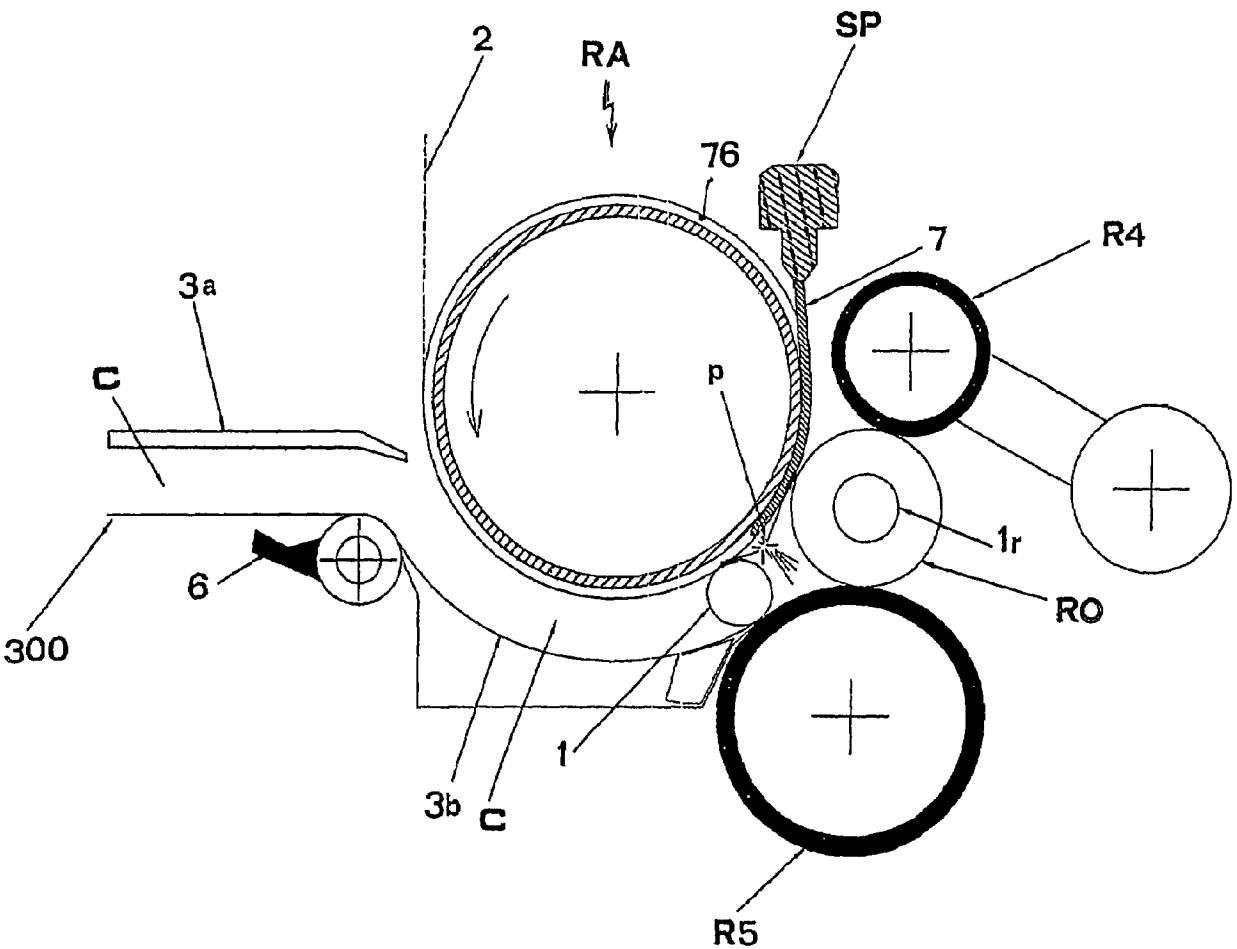

An apparatus according to the invention can be used within a rewinder of any possible construction, as far as the feeding and gluing of the cores (1) and paper webs (2) being used for the production of logs are concerned. Rewinding machines are known to those skilled in the art and, therefore, will not be described herein in details. U.S. Pat. No. 4,487,377, EP 524158, GB 2105688, U.S. Pat. No. 5,979,818 and EP 694020 describe as many examples of embodiments of rewinding machines, so that, reference can be made thereto for a broader description of this type of machines. Essentially, and in the same way as illustrated in FIGS. 1 and 2 of the attached drawings, they comprise:

- a station (A) for feeding the cores (1);
- a store (M) for the cores (1),
- means for feeding and transversally perforating a paper web (2), with the use of a plurality of feeding, driving-out, and cutting rollers (R1, R2, R3, RA) disposed along a predetermined path;
- means for wrapping up the paper (2) onto the cores (1), with the use of a set of winding rollers (RA, R4, R5) two of which (R4, R5) being disposed one above the other at the outlet of a channel (C) delimited in part by a fixed guide consisting of two elements (3*a*, 3*b*), in part by a loop-closed conveyor belt (300), and in part by a roller (RA) which contributes both to the supply of paper (2) and the winding of the latter onto the cores (1) (differently from the rollers which contribute only to the feeding and transverse perforation of the web 2);
- pusher means (6) rotating about respective axes (60) disposed along the said channel (C) for cooperating to the transfer of cores (1) from the store (M), that is, from the inlet station (A), to the first length (3*a*, 300) of channel (C), and to the transfer of the same cores from the first length of channel (C) to the second length (delimited by the guide element 3*b* and by the roller RA);
- means (not shown for the sake of simplicity in the figures of the attached drawings) for the gluing of the paper web (2) and cores (1) to cause the first sheet of each log (RO) to adhere on the corresponding core, and the last sheet of each log (RO) to adhere on the underlying paper.

With a procedure known to those skilled in the art, the web (2) unwinds along the delimited path from the rollers (R1, R2, R3, RA) and winds up onto the core (1*r*) in the station where the rollers (R4) and (R5) are positioned and, in cooperation with the roller (RA) and by rotating about the respective longitudinal axes, cause the paper (2) to wind up onto the core (1*r*). When a preset number of sheets (each of which being delimited by two consecutive transverse perforations of web 2) are wound up on said core, means are made to act for causing a tear of the web (2) at a site of the channel (C) located between a fresh core (1), being introduced into the same channel (C), and the station for the formation of logs (RO) wherein the rollers (R4, R5) operate. The tear is carried out in correspondence of a perforation line (p) which separates the last sheet of the log (RO) in the course of formation from the first sheet of the next log to be formed. Afterwards, the roller (R4), which is mounted on a rotating arm (400) associated with a corresponding actuator (401), is moved away from the underlying roller (R5) to release the log (RO) and making it to move away along an escape plane downstream (402). At this point, the core (1) which, while the formation of the log (RO) is being completed, moves forward and rolls along the channel (C) owing to the contact thereof with the roller (RA), the same core takes up the place of the preceding one and the cycle is identically repeated.

It is understood, however, that in view of the object of the present invention, the said feeding, perforation, gluing and unloading means may be shaped and disposed in any way.

Advantageously, according to the invention, to cause a tearing of the web (2) in correspondence of the transit of a perforation line (p) which separates the last sheet of the log (RO) in the course of formation from the first sheet of the next log to be formed, means (SP) are provided able to direct a jet of compressed air toward the said line (p) thereby causing—with the possible cooperation of the roller (R4) which, in a previous step, may be accelerated to stretch the web (2) in the region interested by the jet—the tearing of the web (2) in correspondence of the same line (p).

For example, reference being made to FIGS. 1, 3, 5A-5D of the attached drawings, the said pneumatic means (SP) comprise a set of nozzles (7) associated, via corresponding solenoid valves (70), with a reservoir of compressed air (71): the said nozzles (7), together with the respective solenoid valves (70) and reservoir (71) being positioned inside the roller (RA) whose outer surface is delimited by a tubular jacket (72) exhibiting a plurality of holes (73) through which the nozzles (7) are able to operate.

Figures 5A, 5B:
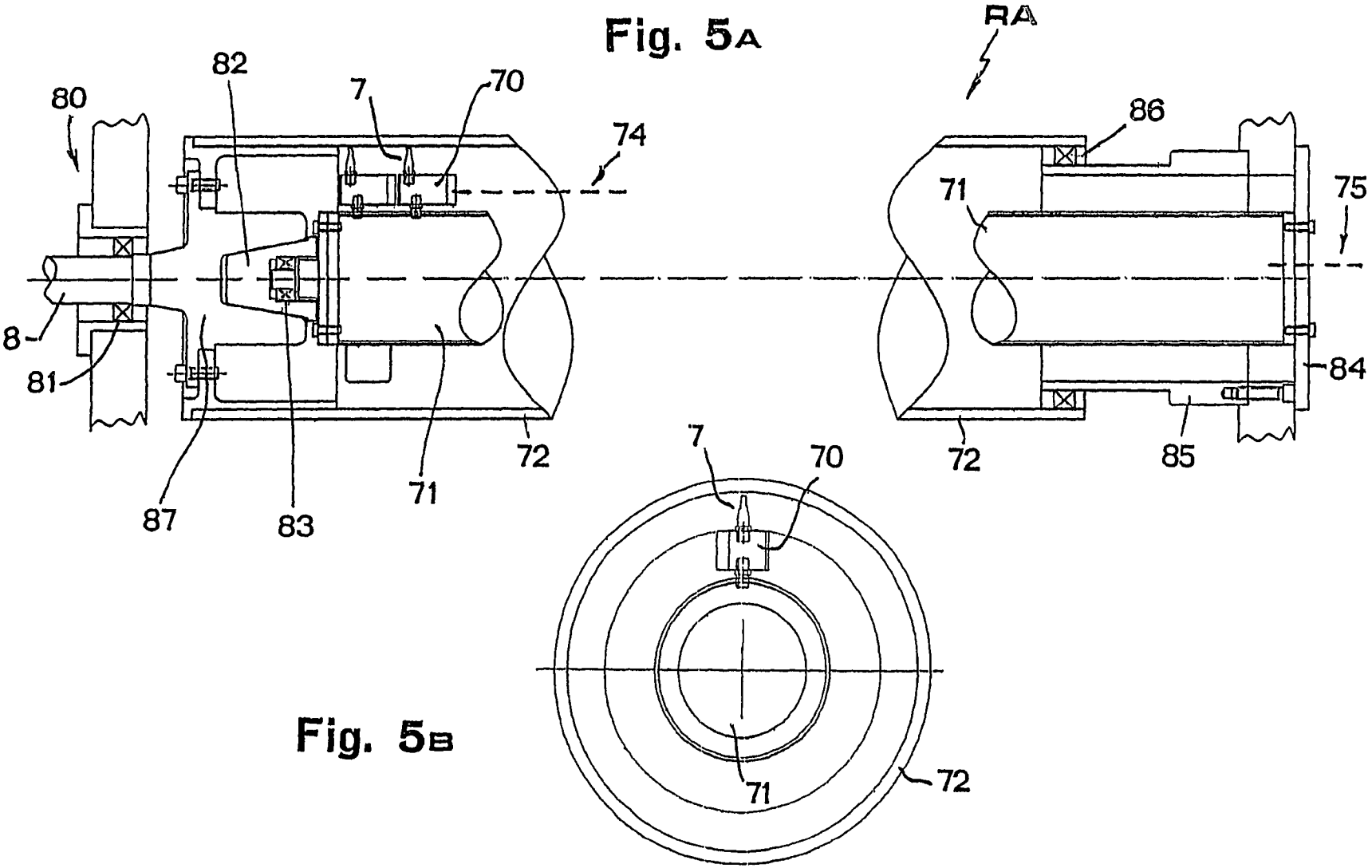
FIG. 5A shows schematically in longitudinal section view, a first exemplary embodiment of a tear-off apparatus, according to the invention, which operates according to the layout of FIGS. 1 and 3.
Figure 5B:
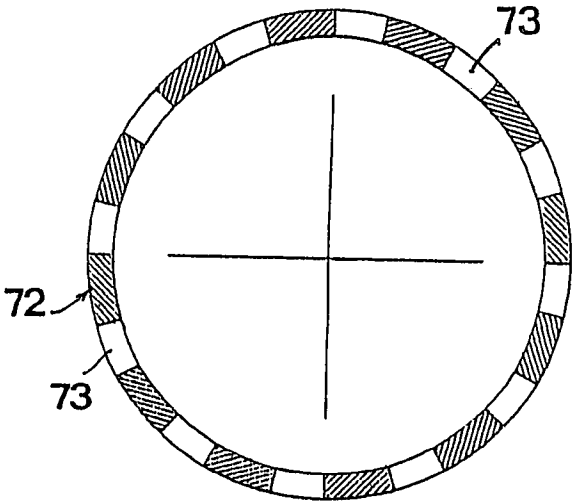
FIG. 5C shows schematically a partial side view of the tubular jacket of the apparatus shown in FIG. 5A.
FIG. 5D is a schematic cross-section view of the tubular jacket shown in FIG. 5C.
Figure 5C:
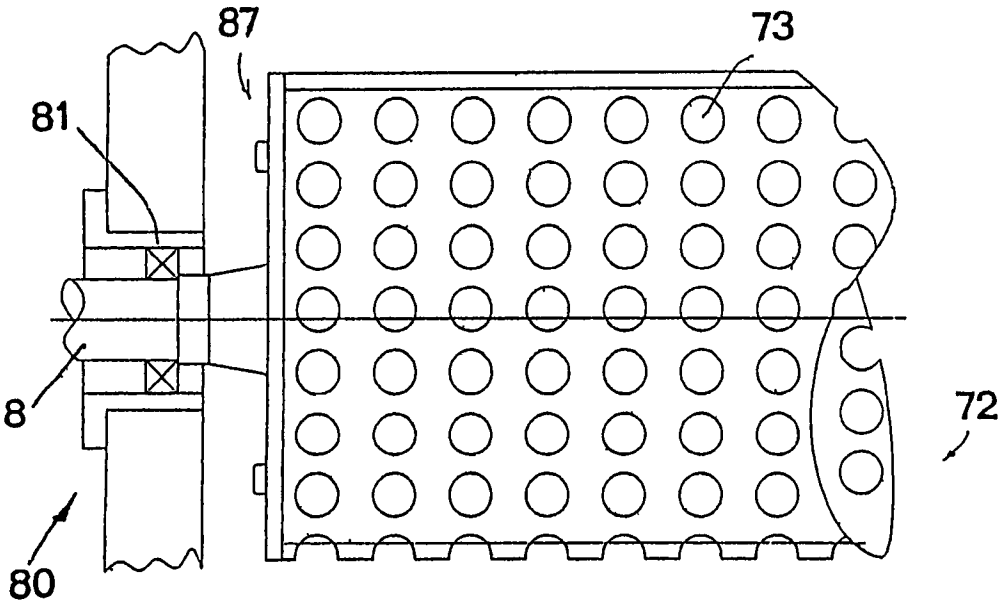
Figure 6A:
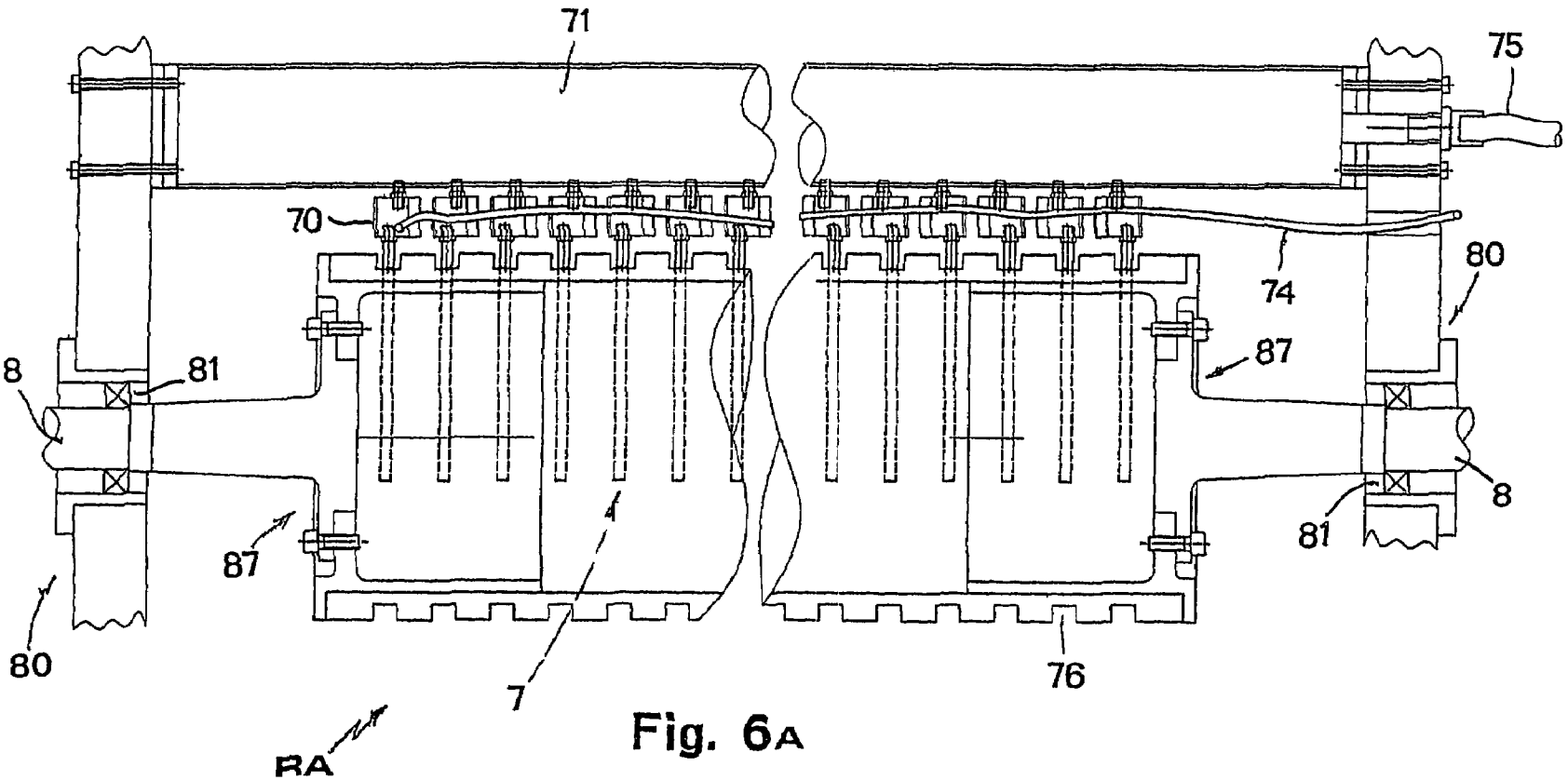
FIG. 6A is a schematic longitudinal section view of a second exemplary embodiment of an apparatus, according to the invention, which operates according to the layouts of FIGS. 2 and 4.
Figure 6C:
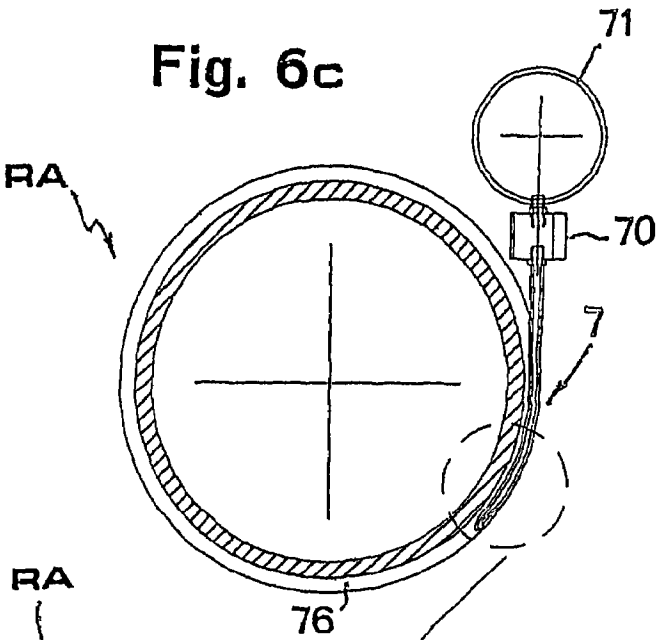
FIG. 6C is a schematic side view in cross-section of the apparatus of FIG. 6A.
Figure 6D:
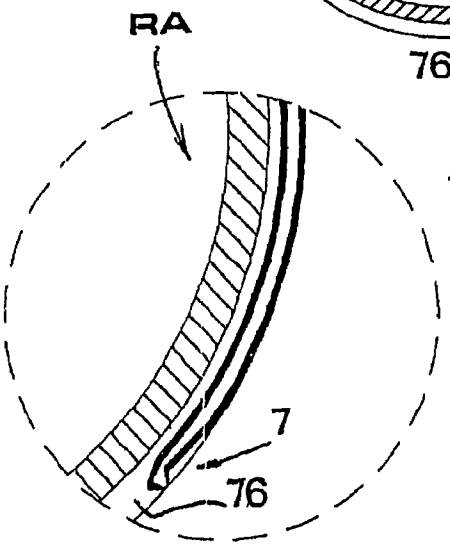
FIG. 6D shows an enlarged detail of the drawing of FIG. 6C.
Figure 6B:
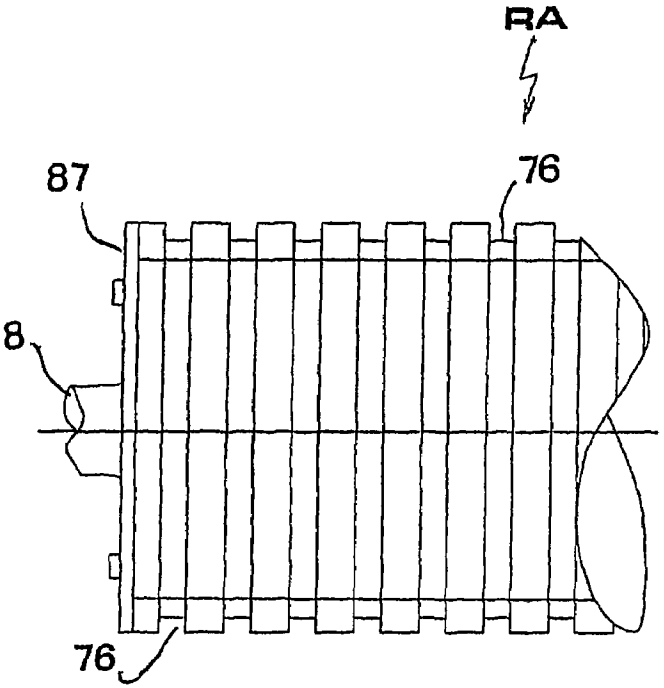
FIG. 6B is a partial side view of the external roller of the apparatus of FIG. 6A.

According to the example shown in FIG. 5A, the said tubular jacket (72) rotates about its longitudinal axis while the said reservoir (71) is fixed and coaxial to the same jacket (72).

To this end, as illustrated in FIG. 5A, the said jacket (72) is provided with a shaft (8) with flanged head (87), which shaft is supported by the stationary part (80) of the machine with the interposition of a bearing (81), and is associated with a corresponding driving means (not shown).

Internally, the said flange (87) has a seat for a conical casing (82) inside which an axial extension of the reservoir (71) is housed with the interposition of a corresponding bearing (83).

On the opposite side, the reservoir (71) is solid to a stationary part (84) of the machine and has a sleeve (85) positioned thereon, the latter having the jacket (72) coaxially mounted thereon with the interposition of a corresponding bearing (86).

In the drawing of FIG. 5A, the reference numbers (74) and (75) designate, respectively, the power cables for the solenoid valves (70) and a pipe for the introduction of air into the reservoir (71).

The solenoid valves (70) are activated to allow a flow of compressed air from the reservoir (71) through the nozzles (7), upon the transit, of a perforation line (p)—separating the last sheet of the log in the course of formation from the first sheet of the next log to be formed—which takes place when the cutting rollers (R2) reach a preset number of revolutions or fraction of a revolution, for example. The consequent tearing action is rapid and accurate. The checking of the number of revolutions of the cutting rollers (R2) may be operated by means of a counter device (100) mounted on the axis of one of the same rollers (R2) in a manner known per se.

Figure 7:
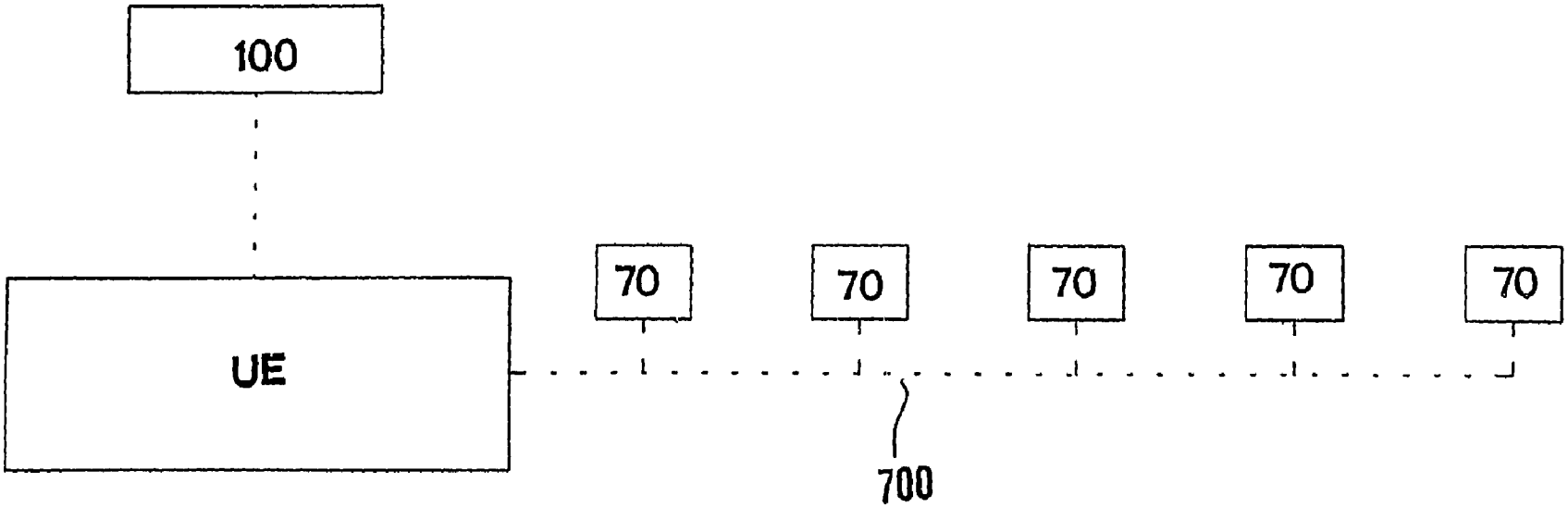
FIG. 7 is a block diagram of the system for operating the devices illustrated in the preceding figures.

As shown in FIG. 7, the activation of said solenoid valves (70) can be automated by means of a programmable electronic unit (UE) which, via the cables (700), sends electrical signals for the activation, respectively, the deactivation of the solenoid valves (70) in response to electrical signals coming from the control device (100) such as an encoder, for example. The said unit (UE) is of a type known to those skilled in the industrial automation field and, therefore, will not be described in greater detail.

As above mentioned, before delivering the air flow through the nozzles (7), the roller (R4) may be accelerated in order to stretch the web (2) in the region interested by the action of the nozzles (7).

Advantageously, as illustrated in FIGS. 5A and 5B of the attached drawings, the nozzles (7) located inside the roller (RA) can be oriented radially to the roller (RA).

Alternatively, as illustrated in FIGS. 2, 4 and 6A-6D of the attached drawings, the said nozzles (7) can be positioned externally to the roller (RA), oriented and directed toward a region between the roller (RA) and the logs (RO)-forming station wherein the winding rollers (R4, R5) are made to operate.

To this end, the roller (RA) may be shaped in such a way as to exhibit a plurality of circumferential grooves (76) wherein the extended and correspondingly curved bodies of the nozzles (7) are positioned, the latter being associated with the reservoir (71) located outside and above the roller (RA). In this example, the roller (RA) has the two ends of the shaft (8) supported by stationary parts (80) of the machine with the interposition of corresponding bearings (81), two head flanges (87) corresponding to said stationary parts solid to both sides of the reservoir (71).

The operation of the device according to the above illustrated example is identical to that previously described.

An operating method according to the invention comprises, therefore, a step for feeding a continuous paper web (2) to a station in which the formation of a log (RO) takes place, the said web (2) being provided with transverse pre-cutting or perforations at regular intervals, and implies interrupting the continuity of the web at a predetermined moment by means of a jet of fluid such as compressed air, for example, directed toward a perforation or pre-cutting line (p) of the web (2).

According to the present method, the said step for the delivery of a jet of fluid may be operated subsequently to a step for the acceleration of roller (R4) which acts on logs (RO) at a log-forming station.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. An apparatus for causing paper webs to tear off within rewinding machines, the apparatus comprising:

a rewinding machine including a web-feeding roller having a tubular jacket outer surface, said tubular jacket outer surface having a plurality of openings;

a web having transverse perforation lines at regular intervals, one perforation line and another perforation line defining a sheet of said web a pneumatic tearing means for tearing of said web upon receiving one of said perforation lines of said web which separates a last sheet of a log being formed from a first sheet of a next log to be formed, wherein said pneumatic tearing means comprises a reservoir of compressed air and a plurality of nozzles associated with a plurality of solenoid valves, said plurality of nozzles and said plurality of solenoid valves producing a jet of compressed air in a direction of said one of said perforation lines said nozzles with said solenoid valves and reservoir being positioned within said web-feeding roller, said openings receiving said jet of compressed air via said nozzles, said tubular jacket rotating about a longitudinal axis thereof, said reservoir being fixed such that said reservoir does not rotate about a longitudinal axis thereof.

2. An apparatus according to claim 1, wherein said tubular jacket is fixed to a driving shaft of said web-feeding roller via a flange and is supported, on a side of said driving shaft, by a first stationary part with a bearing located between said driving shaft and said first stationary part, said flange including a seat for a conical casing inside which an axial extension of said reservoir is located, said reservoir being integrally connected to a second stationary part, said second stationary part being located opposite said first stationary part, said reservoir having a sleeve positioned thereon on which said tubular jacket outer surface is mounted with another bearing located between said tubular jacket outer surface and said sleeve.

3. An apparatus for causing paper webs to tear off within rewinding machines, the apparatus comprising:

a rewinding machine including a web-feeding roller having a tubular jacket outer surface, said tubular jacket outer surface having a plurality of openings;

a web having a plurality of transverse perforation lines, one perforation line and another perforation line defining a sheet, said plurality of transverse perforation lines including a selected perforation line, said selected perforation line defining a last sheet of a log being formed and a first sheet of a next log to be formed;

a conical housing located within said web-feeding roller, said conical housing defining a reservoir, said reservoir being filled with compressed air;

a plurality of solenoid valves;

a plurality of nozzles associated with a plurality of solenoid valves, said plurality of nozzles and said plurality of solenoid valves producing a jet of compressed air in a direction of said selected perforation line, said nozzles with said solenoid valves being positioned within said web-feeding roller, said openings receiving said jet of compressed air via said nozzles, said tubular jacket rotating about a longitudinal axis thereof, said reservoir being fixed such that said reservoir does not rotate about a longitudinal axis thereof.

4. An apparatus according to claim 3, wherein said tubular jacket is fixed to a driving shaft of said web-feeding roller via a flange and is supported, on a side of said driving shaft, by a first stationary part with a bearing located between said driving shaft and said first stationary part, said flange including a seat for a conical casing inside which an axial extension of said reservoir is located, said reservoir being integrally connected to a second stationary part, said second stationary part being located opposite said first stationary part, said reservoir having a sleeve positioned thereon on which said tubular jacket outer surface is mounted with another bearing located between said tubular jacket outer surface and said sleeve.

5. An apparatus for causing paper webs to tear off within rewinding machines, the apparatus comprising:

a rewinding machine including a winding roller and a web-feeding roller having a tubular jacket outer surface, said tubular jacket outer surface having a plurality of openings;

a first core;

a second core;

a web having a plurality of transverse perforation lines, one perforation line and another perforation line defining a sheet, said plurality of transverse perforation lines including a selected perforation line, said selected perforation line defining a last sheet of applied to said first core and a first sheet applied to said second core, said winding roller receiving said web via said web-feeding roller, said winding roller applying said web to said first core until said first core receives a preset number of sheets, said winding roller applying said web to said second core when said first core has received said preset number of sheets, said winding roller rotating at a first speed such that said web is in a non-stretched state, said winding roller rotating at a second speed such that a portion of said web in an area of said selected perforation line is in a stretched state, said first speed being less than said second speed;

a conical housing located within said web-feeding roller, said conical housing defining a reservoir, said reservoir being filled with compressed air;

a plurality of solenoid valves;

a plurality of nozzles associated with a plurality of solenoid valves, said plurality of nozzles and said plurality of solenoid valves producing a jet of compressed air in a direction of said selected perforation line such that said jet of compressed air separates said web at said selected perforation line, said winding roller rotating at said second speed such that said portion of said web in said area of said selected perforation line is in said stretched state when said selected perforation line is separated via said jet of compressed air, said nozzles with said solenoid valves being positioned within said web-feeding roller, said openings receiving said jet of compressed air via said nozzles, said tubular jacket rotating about a longitudinal axis thereof, said conical housing being fixed such that said conical housing does not rotate about a longitudinal axis thereof

6. An apparatus according to claim 5, wherein said tubular jacket is fixed to a driving shaft of said web-feeding roller via a flange and is supported, on a side of said driving shaft, by a first stationary part with a bearing located between said driving shaft and said first stationary part, said flange including a seat for a conical casing inside which an axial extension of said reservoir is located, said reservoir being integrally connected to a second stationary part, said second stationary part being located opposite said first stationary part, said reservoir having a sleeve positioned thereon on which said tubular jacket outer surface is mounted with another bearing located between said tubular jacket outer surface and said sleeve.

* * * * *